US005163661A

United States Patent [19]

Turner et al.

[11] Patent Number: 5,163,661

[45] Date of Patent: Nov. 17, 1992

[54] DOOR SUPPORT CLAMP

[76] Inventors: William D. Turner, 741 Center Dr.; Jack M. Culp, 2550 Everett Ave., both of Memphis, Tenn. 38112

[21] Appl. No.: 762,894

[22] Filed: Sep. 19, 1991

[51] Int. Cl.[5] ..... B25B 5/10

[52] U.S. Cl. ..... 269/97; 269/243; 269/274

[58] Field of Search ..... 269/243, 274, 152–155, 269/41, 43, 45, 203, 147–149, 249, 97, 98

[56] References Cited

U.S. PATENT DOCUMENTS

| | | | |
|---|---|---|---|
| 2,450,994 | 10/1948 | Schaefer | 269/249 |
| 2,468,358 | 4/1949 | Clark | 269/45 |
| 2,781,803 | 2/1957 | Nelson | 269/91 |
| 3,061,302 | 10/1962 | Dennis | 269/154 |
| 3,957,261 | 5/1976 | Hefel | 269/243 |
| 4,834,352 | 5/1989 | Thornton | 269/274 |

FOREIGN PATENT DOCUMENTS

| | | | |
|---|---|---|---|
| 80960 | 6/1983 | European Pat. Off. | 269/203 |
| 52369 | 3/1942 | Netherlands | 269/97 |

*Primary Examiner*—Robert C. Watson

*Attorney, Agent, or Firm*—Walker, McKenzie & Walker

[57] ABSTRACT

A device for supporting and clamping workpieces, such as doors or boards, against the ends of vertically-set sawhorses legs in such a way that the edge of such workpieces is located at a convenient working height. Such operations as planing, hinge mortising, routing, belt sanding or the like are facilitated by this arrangement.

An internally threaded tube (20) accepts at one end a bolt (40) carrying leg clamping jaw (32). At the other end the tube (20) accepts another bolt (54) carrying a movable elongated door clamping jaw (44). A third, non-movable leg clamping jaw (26) is affixed to tube (20) about 76.2 mm (3") from jaw (32). The entire door support clamp is clamped to a sawhorse leg between jaws (32) and (44), resulting in the remaining portion of tube (20) being cantilevered out beyond the sawhorse leg. This resultant cantilevered support area (60) of tube (20) is then available for support of workpieces with clamping readily available by jaw (44).

4 Claims, 1 Drawing Sheet

DOOR SUPPORT CLAMP

BACKGROUND—FIELD OF INVENTION

This invention relates to woodworking clamps; specifically, this is a clamp designed to support doors, boards, windows, and other workpieces on edge and then to clamp them securely against sawhorse legs to facilitate planing, mortising, sanding, and other woodworking operations.

BACKGROUND—CROSS REFERENCE TO RELATED APPLICATIONS

This door support clamp is related to an invention submitted by William D. Turner for a "TRIPLY-BRACED FOLDING SAWHORSE BRACKET" (received PTO Jul. 25, 1991, File #07/736007). A sawhorse made with this bracket is ideally suited for use with the door support clamp.

One set (two) door support clamps used in conjunction with sawhorses made with the "TRIPLY-BRACED FOLDING SAWHORSE BRACKET" constitute a "system". With this "system", one set of clamps can readily be used on any set of like sawhorses situated on any of one or more job sites.

BACKGROUND—DISCUSSION OF PRIOR ART

Sanding, planing, and mortising the edges of doors, boards, and other workpieces are some of the most basic and routinely performed procedures of carpentry. Despite this, however, there is not an efficient, versatile, and stable means for supporting and securing the object on which these procedures are to be performed.

Carpenters will sometimes address the problem as the need arises by building temporary devices from available scrap lumber. This procedure is time consuming, inefficient, and usually does not provide optimal support.

Door jacks and vertical holding vises that are currently available have only limited usefulness. Since they stand on the floor, their usefulness is limited to wider doors. Door jacks are also bulky and cumbersome to transport or store when not in use. Also, these door jacks and vertical holding vises do not provide for a convenient surface for the tools and hardware in use when working on the door or other workpiece.

Although a combination of pipe clamp parts currently available can be assembled to roughly duplicate the functions of this door support clamp, it has proved to be cumbersome, obtrusive, and offered no protection against marring of the workpiece.

OBJECTS AND ADVANTAGES

Accordingly, there are several objects and advantages to our invention. These include, but are not limited to:

(a) to provide a device which will support and secure doors, boards, and other workpieces of various widths, thicknesses, and lengths for the purpose of working on their edges;

(b) to provide a device that has the flexibility to allow the carpenter to place the workpiece at an optimal working height;

(c) to provide a device that is compact and therefore does not intrude on the carpenter's movements or is likely to impede the travel of electrical cords attached to electric tools;

(d) to provide a device which is easy to set-up and breakdown;

(e) to provide a device which is convenient and easy to store;

(f) to provide a device which does not dent, mar, or otherwise damage the workpiece;

(g) to provide a device which (although especially designed for use with a sawhorse made with the "TRIPLY-BRACED FOLDING SAW-HORSE BRACKET"), can be used on any sawhorse as long as it meets the four necessary conditions met by "TRIPLY-BRACED FOLDING SAW-HORSE BRACKET" made sawhorses, those being:

1. vertically held legs;
2. all wood support members;
3. no obstruction by an overlapping top beam;
4. no hardware obstructions.;

(h) to provide a device that is used in conjunction with sawhorses so that the tops of the sawhorses to which the door support clamps are attached can support a board which becomes a convenient shelf for tools and hardware being used.

DRAWING FIGURES

REFERENCE NUMERALS IN DRAWINGS

Figure 1:
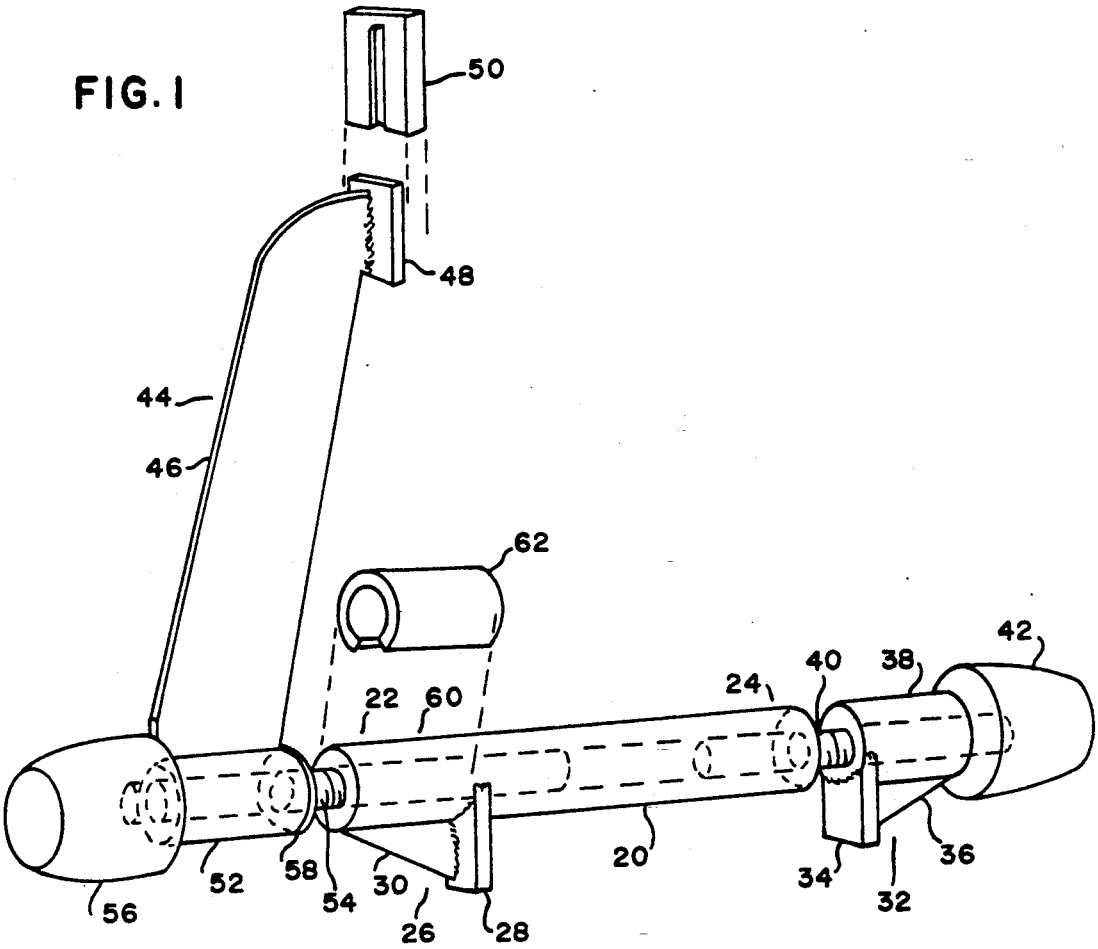
FIG. 1 is a perspective view of the door support clamp exhibiting a typical embodiment.

20 internally threaded tube
22 proximal end of internally threaded tube
24 distal end of internally threaded tube
26 outside sawhorse leg clamping jaw
28 outside sawhorse leg clamping jaw plate
30 outside sawhorse leg clamping jaw brace
32 inside sawhorse leg clamping jaw
34 inside sawhorse leg clamping jaw plate
36 inside sawhorse leg clamping jaw brace
38 inside sawhorse leg clamping jaw base
40 inside sawhorse leg clamping jaw bolt
42 inside sawhorse leg clamping jaw bolt handle
44 door clamping jaw
46 door clamping jaw elongated clamping arm
48 door clamping jaw clamping plate
50 door clamping jaw clamping plate pad
52 door clamping jaw base
54 door clamping jaw bolt
56 door clamping jaw bolt handle
58 door clamping jaw stop washer
60 cantilevered door support area
62 cantilevered support area pad

Figure 2:
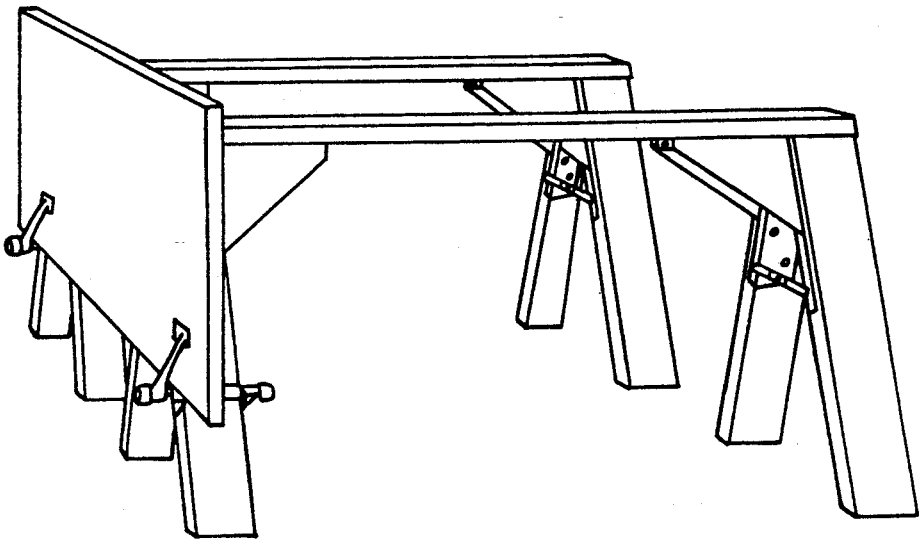
FIG. 2 shows two door support clamps in use on a pair of sawhorses in a typical application.

DESCRIPTION—FIGS. 1 and 2

A typical embodiment of the door support clamp is illustrated in FIG. 1. The door support clamp is comprised of an internally threaded tube 20, with a distal end 24, and a proximal end 22. Tube 20 is a metal rod 127 mm (5") long and 25.4 mm (1") in diameter. Tube 20 is internally threaded from one end to the other end such that it will accept threaded rods or bolts 12.7 mm (½") in diameter.

An outside sawhorse leg clamping jaw 26 is affixed to the underside of the tube 20 at proximal end 22. Jaw 26 is comprised of a jaw plate 28 and a jaw brace 30. Jaw plate 28 is 6.5 mm×25.4 mm×44.5 mm (¼"×1"×1¾") with a semi-circular area of material 12.7 mm (½") radius removed from the top edge from corner to corner. Jaw plate 28 is affixed to tube 20, perpendicularly to length of tube 20, with concave, semi-circular area adjacent to outside curvature of tube 20. Jaw brace 30 is a right triangle in shape with one side being 38.1 mm (1½") and the other side being 31.8 mm (1¼"). The short side of jaw brace 30 is affixed to proximal side of jaw plate 28 along the center line of jaw plate 28. The long side of jaw brace 30 is affixed to underside of tube 20 parallel to length of tube 20. Jaw 26 thereby is affixed to underside of tube 20 from proximal end 22 to a point 44.5 mm (1¾") from proximal end 22.

At distal end 24 of tube 20 is an inside sawhorse leg clamping jaw 32 carried on an inside sawhorse leg clamping bolt 40. Bolt 40 is 12.7 mm×101.6 mm (½"×4"), with 38.1 mm (1½") of threading at one end and 19.1 mm (¾") of threading at the opposite end, with an unthreaded shank in between being 44.5 mm (1¾") in length. The longer threaded end of bolt 40 inserts into the distal end 24 of tube 20. The shorter threaded end accepts an internally threaded inside sawhorse leg clamping bolt handle 42. Handle 42 is a modified prolated spheroid shape, similar to a football cut in half across its axis with the point cut off, yielding two flat circular bases, different in diameter. The length of handle 42 is 50.8 mm (2"); the larger base is 50.8 mm (2") in diameter; the smaller base is 38.1 mm (1½") in diameter. The larger base is internally threaded to accept the shorter threaded end of bolt 40, and is secured by epoxy glue.

Clamping jaw 32, which is carried on the unthreaded shank portion of bolt 26, is comprised of an inside sawhorse leg clamping jaw base 38. Base 38 is a section of metal rod 44.5 mm (1¾") long×25.4 mm (1") in diameter, bored longitudinally slightly larger than 12.7 mm (½") in diameter. An inside sawhorse leg clamping jaw plate 34 and an inside sawhorse leg clamping jaw brace 36 are attached to underside of base 38 of jaw 32. Jaw 32 is carried on bolt 40 so that jaw plate 34 faces distal end 24 of tube 20.

At the proximal end 22 of tube 20 is a door clamping jaw 44 carried on a door clamping jaw bolt 54. Bolt 54 is 12.7 mm×152.4 mm (½"×6"), with 88.9 mm (3½") of threading at one end and 19.1 mm (¾") of threading at the opposite end, with an unthreaded shank in between being 44.5 mm (1¾") in length. The longer threaded end of bolt 54 inserts into the proximal end 22 of tube 20. The shorter threaded end accepts an internally threaded door clamping jaw bolt handle 56 identical to handle 42. A door clamping jaw stop washer 58 is affixed to bolt 54 at the point where the unthreaded shank meets the threadings of the longer threaded end.

Door clamping jaw 44, which is carried on the unthreaded shank portion of bolt 54, is comprised of a door clamping jaw base 52, a door clamping jaw elongated clamping arm 46, a door clamping jaw clamping plate 48, and a door clamping jaw clamping plate pad 50. Base 52 is a section of metal rod 38.1 mm (1½") long×25.4 mm (1") in diameter, bored longitudinally, slightly larger than 12.7 mm (½") in diameter. Arm 46 is a five sided piece of 6.4 mm (¼") metal. The base of arm 46 is 38.1 mm (1½") in length. The first distal edge is 127 mm (5") in length and is inclined distally from the base at an angle of 100 degrees. At the end of the first distal edge, a second distal edge begins and forms an angle of 170 degrees with first distal edge, and is 38.1 mm (1½") in length. The first proximal edge is 12.7 mm (½") in length and is inclined at an angle of 90 degrees from the base. At the end of the first proximal edge, a second proximal edge begins and forms an angle of 163 degrees with the first proximal edge, and is straight for 133.4 mm (5¼"), and then is curved to meet the end of the second distal edge.

Clamping plate 48 is a 6.4 mm×38.1 mm×38.1 mm (¼"×1½"×1½") piece of metal and is affixed at its center line to the second distal edge of arm 46. Clamping pad 50 is a five-sided moulded piece of rubber designed to fit over plate 48 with a slot on its proximal side to accomodate arm 46.

Door clamping jaw 44 is affixed at its base longitudinally to base 52.

The first 44.5 mm (1¾") of proximal end 22 of tube 20 will constitute a cantilevered support area 60 when the door support clamp is in use. A cantilevered support area pad 62, made from split rubber tubing, 38.1 mm (1½") long and 22.2 mm (½") inside diameter, fits over area 60.

From the above described description, a number of advantages of our door support clamp become evident:

(a) tube 20 can be secured readily to sawhorse legs of various widths and thicknesses;

(b) jaw 44 rotates on bolt 54 giving the user freedom to locate pad 62 in the most appropriate place against the workpiece;

(c) tube 20 can be secured on the sawhorse leg and jaw 44 secured against the workpiece with simple turns of the wrist;

(d) tube 20 can be affixed to the sawhorse leg at whatever height the user desires.

(e) pads 50 and 62 protect the workpiece from dents, mars, and the like.

OPERATION—FIGS. 1 AND 2

In use, one door support clamp is affixed to one leg of a sawhorse by placing tube 20 against the wide side of the leg at a height that will put the upper edge of the workpiece at a desired height for the user. Handle 42 is then tightened until jaw 32 and jaw 26 press securely against the sawhorse leg. The same procedure is then done with a second clamp on one leg of a second sawhorse.

The workpiece is then placed on the cantilevered support area 60 of tube 20. Jaw 44, already loosened, can be swung to an upright position and then tightened against the workpiece at the desired location. This is accomplished by turning handle 56 until the workpiece is snug between the plate pad 50 and the all wood surface of the sawhorse legs. Should the workpiece, such as a door, have glass panes or thin wood panels, jaw 44 can be rotated counter-clockwise or clockwise to engage a more substantial part of the door or workpiece.

After clamping, the edge of the workpiece is now at the desired height, firmly secured, and ready to be worked.

Accordingly, the reader can see the several advantages of using the door support clamps when doing edgework on doors, boards, and other workpieces. Some of these are:

(a) any workpiece can be placed at the optimal height and held securely;

(b) a wide board laid across the sawhorse tops provides a convenient place to put tools and virtually eliminates the constant bending over to pick up tools and loss of small pieces of hardware and screws;

(c) as seen in FIG. 2, the clamps are compact, therefore not likely to hinder the user's movement or snag electrical cords.

(d) the shape of handles 42 and 56 is designed to "shed" electrical cords.

Although the description above contains many specificaties, these should not be construed as limiting the scope of the invention but as merely providing illustrations of some of the presently preferred embodiments of the invention. For example, tube 20 could be externally threaded, have a different shape or be longer or shorter than the dimension given in the example; jaw 44 could have a different shape and be made of wood or other material; tube 20 and bolts 40 and 54 could be made of plastic, etc. . .

Thus the scope of the invention should be determined by the appended claims and their legal equivalents, rather than by the examples given above.

We claim:

1. A clamping device for clamping a workpiece to a supporting means, the supporting means having a first side, a second side and a face extending between the first and second sides; said clamping device comprising:

(a) a coupling member for extending over a face of a supporting means; said coupling member being an internally threaded tube;

(b) a first stop means attached to said coupling member for engaging a first side of the supporting means;

(c) a second stop means attached to said coupling member for engaging a second side of the supporting means and for coacting with said first stop means to form a first jaw means for clamping the supporting means between said first and second stop means with said coupling member extending over the face of the supporting means; and (d) a third stop means attached to said coupling member for engaging a first side of a workpiece and for coacting with the supporting means to form a second jaw means for clamping the workpiece between said third stop means and the supporting means.

2. A clamping device for clamping a workpiece to a supporting means, the supporting means having a first side, a second side and a face extending between the first and second sides; said clamping device comprising:

(a) a coupling member for extending over a face of a supporting means; said coupling member including a coupling body having a first end and a second end; said coupling body having an internally threaded aperture extending from said first and second ends thereof;

(b) a first stop means attached to said coupling member for engaging a first side of the supporting means;

(c) a second stop means attached to said coupling member for engaging a second side of the supporting means and for coacting with said first stop means to form a first jaw means for clamping the supporting means between said first and second stop means with said coupling member extending over the face of the supporting means; said second stop means being movably attached to said second end of said coupling body for allowing the distance between said first and second stop means to be varied when clamping the supporting means between said first and second stop means; said second stop means including an externally threaded bolt for being screwably attached to said internally threaded aperture in said coupling body; said second stop means including a body having an aperture therethrough for allowing said externally threaded bolt of said second stop means to extend therethrough; said second stop means including a stop flange fixedly attached to said body of said second stop means and projecting perpendicularly therefrom; and (d) a third stop means attached to said coupling member for engaging a first side of a workpiece and for coacting with the supporting means to form a second jaw means for clamping the workpiece between said third stop means and the supporting means; said third stop means being movably attached to said first end of said coupling body for allowing the distance between said third stop means and the supporting means to be varied when the supporting means is clamped between said first and second stop means and when clamping the workpiece between said third stop means and the supporting means; said third stop means including an externally threaded bolt for being screwably attached to said internally threaded aperture in said first end of said coupling body; said third stop means including a body having an aperture therethrough for allowing said externally threaded bolt of said third stop means to extend therethrough; said third stop means including a stop flange fixedly attached to said body of said third movable stop means and projecting perpendicularly therefrom.

3. The clamping device of claim 2 in which said first stop means is fixedly attached to said coupling body at a point between said first and second ends of said coupling body; and in which the portion of said coupling body between said first stop means and said first end of said coupling body forms a cantilevered portion for supporting a portion of the workpiece when the supporting means is clamped between said first and second stop means and the workpiece is clamped between said third stop means and the supporting means.

4. The clamping device of claim 3 in which is included a first pad means for covering at least part of said cantilevered portion of said coupling body; and in which is included a second pad means for covering at least a portion of said third stop means.

* * * * *